US006104270A

United States Patent [19]

Elias

[11] Patent Number: 6,104,270

[45] Date of Patent: Aug. 15, 2000

[54] LIFTER WITH ELECTROPERMANENT MAGNETS PROVIDED WITH A SAFETY DEVICE

[75] Inventor: Gregory E. Elias, Curaçao, Netherlands Antilles

[73] Assignee: Railfix N.V., Netherlands

[21] Appl. No.: 09/194,392

[22] PCT Filed: Aug. 4, 1997

[86] PCT No.: PCT/IB97/00960

§ 371 Date: Nov. 30, 1998

§ 102(e) Date: Nov. 30, 1998

[87] PCT Pub. No.: WO99/08293

PCT Pub. Date: Feb. 18, 1999

[51] Int. Cl.[7] ..... H01F 7/20

[52] U.S. Cl. ..... 335/289; 335/291

[58] Field of Search ..... 361/142–4; 335/284, 335/285, 289, 290, 291

[56] References Cited

U.S. PATENT DOCUMENTS

| | | | |
|---|---|---|---|
| 3,978,441 | 8/1976 | Sobottka et al. | 335/284 |
| 4,237,455 | 12/1980 | Beckley et al. | 340/685 |
| 4,910,633 | 3/1990 | Quinn | 361/144 |
| 4,956,625 | 9/1990 | Cardone et al. | 335/290 |
| 4,965,695 | 10/1990 | Baumann | 361/142 |
| 5,642,089 | 6/1997 | Lysen | 335/285 |

FOREIGN PATENT DOCUMENTS

| | | |
|---|---|---|
| 04345498 | 12/1992 | Japan . |
| 2 043 354 | 10/1980 | United Kingdom . |
| 97/03911 | 2/1997 | WIPO . |

*Primary Examiner*—Lincoln Donovan
*Attorney, Agent, or Firm*—Michael Best & Friedrich LLP

[57] ABSTRACT

A lifter comprising at least a reversible magnet (5, 5') arranged with its polarities oriented along a vertical axis above at least a magnet (6, 6') provided with at least a pair of permanent magnets (**6*a*, 6*a*') arranged with the polarities oriented along an horizontal axis on the sides of at least a ferromagnetic core (6*b*, 6*b*') suitable to contact the load (18) to be lifted, at least a magnetic sensor (11) arranged close to the base (6*c*, 6*c*') of said ferromagnetic core, and a further magnetic sensor (12) arranged over said permanent magnets (6*a*, 6*a*') so as to measure substantially only the magnetic flux passing through the reversible magnet (5, 5'), as well as a safety device (13) for processing the signals transmitted by said magnetic sensors (11, 12) and obtaining the working point of the lifter on the magnetization curve (14) of the reversible magnet (5, 5'**).

10 Claims, 3 Drawing Sheets

2
2
1
3
3
3
4
S
N
N
S
N
Δ
18

LIFTER WITH ELECTROPERMANENT MAGNETS PROVIDED WITH A SAFETY DEVICE

The present invention relates to magnet lifters, and particularly to a lifter with electropermanent magnets provided with a safety device for controlling their working point.

As it is known, lifters are divided into three classes depending on the type of used magnets, i.e. permanent magnets, electropermanent magnets and electromagnets. Each lifter type has its own advantages and drawbacks.

The lifters with permanent magnets have the advantage of an almost negligible power consumption and of a produced magnetic force which is reliably constant and independent of outer supply sources. On the other hand, it is not possible to increase the magnetic force if necessary and the magnets are exceedingly bulky for lifting heavy loads. Furthermore, the load detachment requires the application of a considerable mechanical power amount in order to reduce the magnetic force to a value smaller than the load weight. Alternatively, the magnets are to be made movable so as to be moved away from the load, thus decreasing the magnetic attraction.

On the contrary, in the lifters with electromagnets it is possible to freely vary the magnetic force by simply adjusting the current flowing in the windings which generate the magnetic field. However, any breakdown, even if very short, of the power supply immediately cancels the magnetic force and thus causes the load detachment. It is therefore evident that safety systems ensuring the supply continuity are essential.

The lifters with electropermanent magnets substantially combine the advantages of the two aforementioned lifter types. This is due to the use of a permanent magnet of the reversible type, i.e. a magnet wherein the polarity is easily reversible through the application of an electric impulse. The reversible magnet thus generates an adjustable flux which also can direct the flux of a conventional permanent magnet combined therewith. It is thus possible to short-circuit the two magnets when the lifter is to be deactivated, or arrange them in parallel for activating the lifter. Since just an electric impulse but not a continuous supply is needed for reversing the reversible magnet, the safety problems affecting electromagnets are overcome. At the same time, even though permanent magnets are used, it is possible to vary the magnetic force within some limits, and the load detachment is easy to carry out with a minimum power consumption and without complex structures for moving the magnets.

However, the electropermanent magnets, with respect to the other two types of magnets, have a drawback in the working instability due to the particular magnetization curve of the reversible magnet. In fact the reversible magnets are usually made of an aluminum-nickel-cobalt (alnico) alloy having an hysteresis characterized in that a high induction corresponds to a reduced coercive force. This characteristic allows to direct the magnetic flux in the permanent magnet forming the electropermanent magnet.

However, the magnetization curve has a "knee" beyond which the behavior of the reversible magnet is still linear, but much more sloped than in the first region. This involves great induction variations corresponding to small coercive force variations. Practically this means that the lifters with electropermanent magnets are greatly affected by the dynamics of the lifted material. It is in fact known that the oscillations of the plates lifted by such a unit involve a variation of the air gap, and accordingly a variation of the total reluctance of the magnetic circuit, which may shift the working point of the magnetic masses of the lifter below said "knee". This dynamics is affected even by little shifts of the lifted material and thus slight bendings or hardly detectable curvings are enough to cause a considerable variation of the magnetomotive force thereby making the lifting system very unstable.

In the known lifters there is a system for measuring the magnetic force which is the same for any type of magnets. This measuring system only serves to calculate the safety operative factor by comparing the generated magnetic force with the weight of the load to be lifted. This is carried out by arranging a measuring coil close to the pole pieces contacting the load, so as to quite accurately measure the total flux linked with the load. Such a measure obviously gives no indication about the working point, so it is not capable of signaling the risk resulting from the instability, if any, of the reversible magnet.

It is an object of the present invention to provide a lifter with electropermanent magnets provided with a safety device which allows to control the instability, if any, of the lifting unit depending on the actual working conditions.

Such an object is achieved by means of a lifter provided with a sensor capable of measuring the only contribution of the reversible magnet and accordingly its working point.

The main advantage of the present lifter is thus to ensure the highest operating safety by indicating not only the total safety factor but also the approach of the instability condition.

Another advantage of the lifter according to the present invention is that, by suitably combining the data supplied by the sensor measuring the reversible magnet flux with the data supplied by the sensor measuring the total magnetic flux, it is possible to compensate the reading error of the latter due to the magnetic dispersions caused by the air gap between the active polarities and the load, said error being proportional to the air gap size.

Further advantages and features of the lifter according to the present invention will be evident to those skilled in the art from the following detailed description of an embodiment thereof with reference to the attached drawings, wherein.

Figure 1:
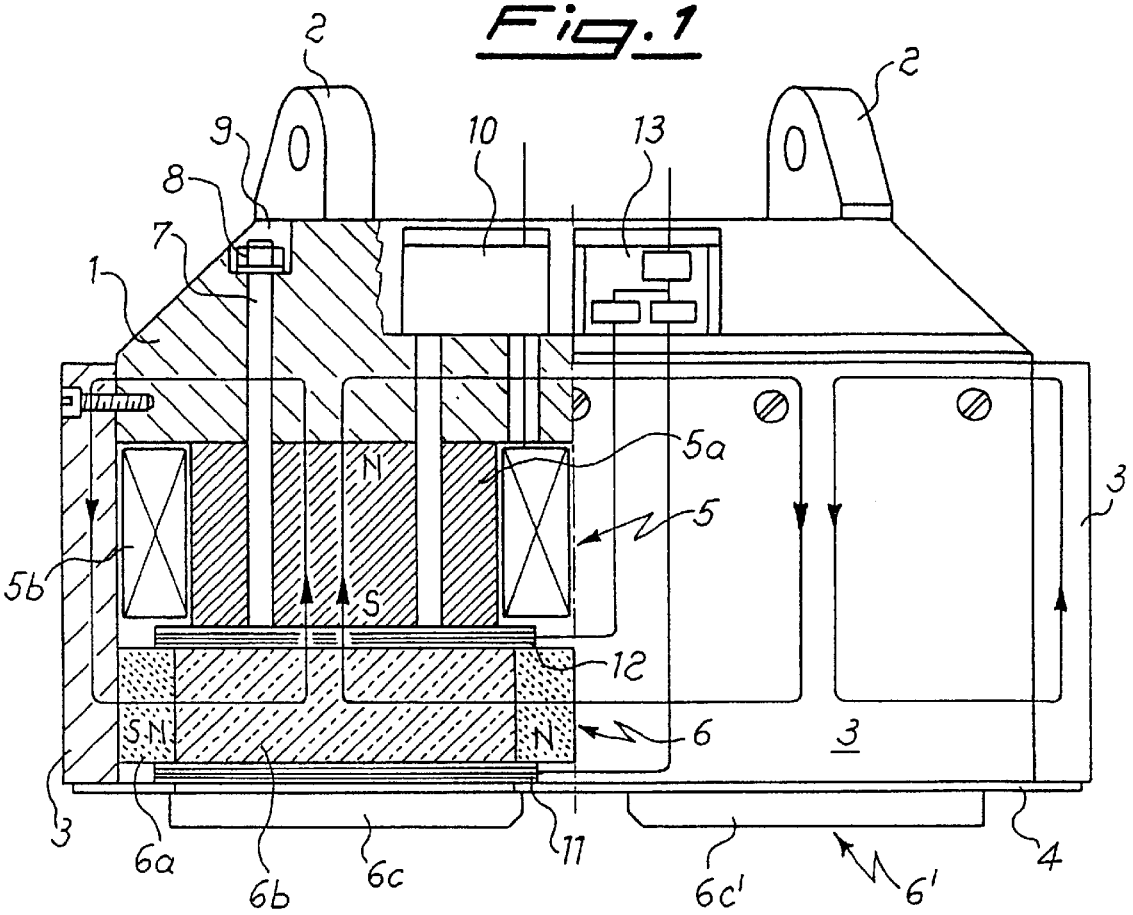
FIG. 1 is a front diagrammatic view, with the left half in section, of a lifter according to the invention in the non-working phase.

Referring to FIG. 1, the lifter with electropermanent magnets according to the present invention in a known way comprises an outer supporting structure, a plurality of magnets and an adjustment and control unit.

The supporting structure consists in an upper block 1, provided with joints 2 for the fastening to lifting means, e.g. a crane, four sides 3 and a closing base plate 4. Obviously such a structure is made of highly magnetically conductive materials in order to minimize the reluctance of the magnetic circuit.

Each electropermanent magnet is formed by a reversible magnet 5 and a permanent magnet 6 arranged one above the other respectively. The polarities of reversible magnet 5 are arranged on the horizontal sides of a core 5*a,* made of alnico, around which a commuting coil 5*b* is arranged for controlling the pole reversal. While the lifter is not working, as shown in FIG. 1, the north pole (N) is on the upper side and the south pole (S) in on the lower side.

Permanent magnet 6 comprises a plurality of ferrite blocks 6*a* arranged along the lateral sides of an iron core 6*b*. This core 6*b* is fastened to block 1 through a plurality of bars 7 passing through the alnico core 5*a* and constrained by nuts 8 into suitable seats 9. Thus, also reversible magnet 5 is fastened under block 1. Core 6*b* extends downwards in a pole piece 6*c*, protruding from plate 4 and intended to contact the load to be lifted.

Figure 2:
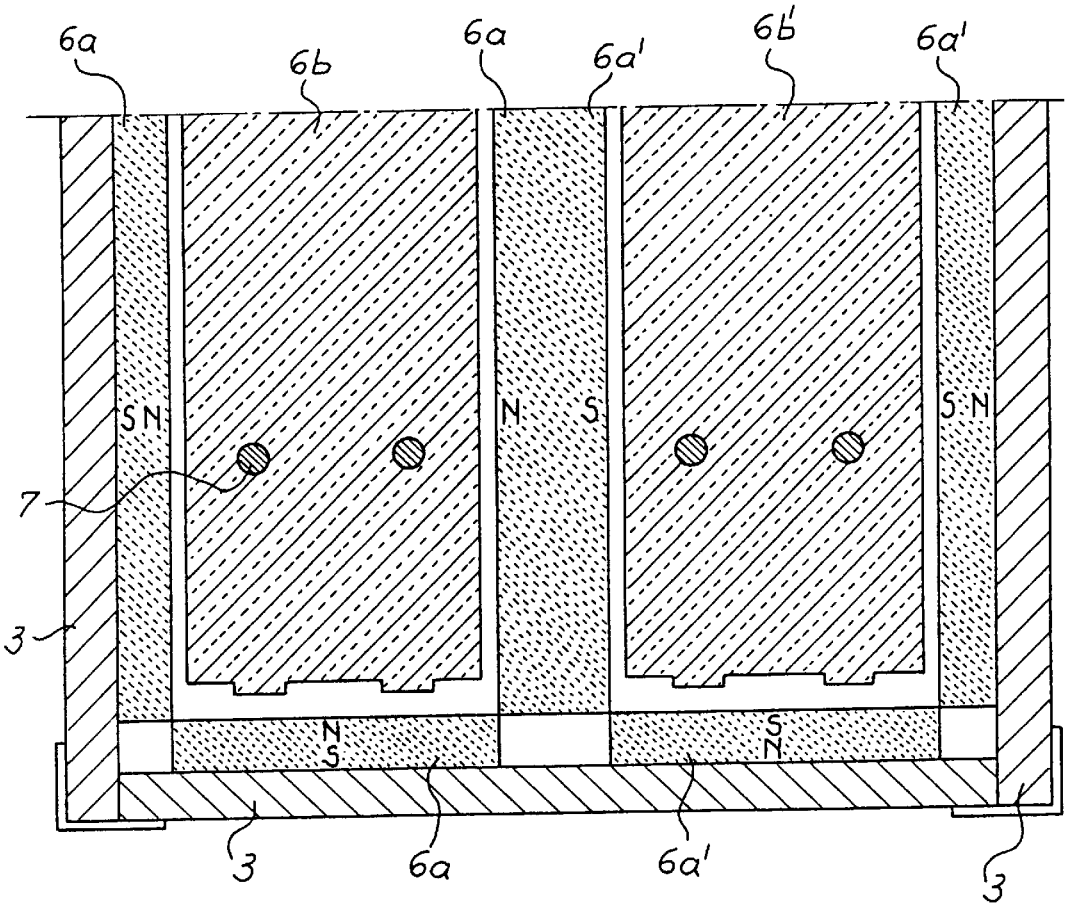
FIG. 2 is a partial view in horizontal section of a symmetrical half of the lifter of FIG. 1.

The arrangement of the polarities of ferrite blocks 6*a* is clearly shown in FIG. 2, wherein on all sides the north pole is facing core 6*b* and the south pole is facing outwards.

The above description relates to magnets 5, 6, arranged on the left of the lifter shown in FIG. 1, i.e. to those visible in the half section. For closing of the magnetic circuits indicated by the arrows, another electropermanent magnet is suitably arranged with the reversed polarities in the right half of the lifter. In other words, there is a second reversible magnet 5' having its south pole on the upper side and its north pole on the lower side. Second permanent magnet 6' likewise comprises a plurality of ferrite blocks 6*a*' arranged with their south poles facing core 6*b*' and their north poles facing outwards (see FIG. 2).

This magnet arrangement induces a magnetic field comprising three sheaves of flux lines substantially oriented in the direction indicated by the arrows of FIG. 1. The middle sheaf of these flux lines passes through the two reversible magnets 5, 5', the two cores 6*b*, 6*b*' and ferrite blocks 6*a*, 6*a*' arranged therebetween, besides some portions of the outer supporting structure. The two side sheaves of flux lines pass instead through only one of reversible magnets 5, 5', one of cores 6*b*, 6*b*' and ferrite blocks 6*a*, 6*a*' arranged between one of these cores and sides 3. Such flux lines, being linked together, flow inside the lifter, so that a ferromagnetic load, arranged close to pole pieces 6*c*, 6*c*', would not be attracted by the lifter.

The adjustment and control circuits comprise at least a control circuit 10 of commuting coil 5*b*, a first magnetic sensor 11 and a second magnetic sensor 12 respectively arranged above and under ferrite blocks 6*a*, as well as at least a safety device 13 for processing the signals coming from said sensors 11 and 12. Lower magnetic sensor 11 consists for instance of a coil having its loops surrounding the base of core 6*b* in order to measure the flux linked with the load. Upper magnetic sensor 12, consisting for instance of a further coil having its loops surrounding the upper portion of core 6*b*, is the innovative aspect of the present lifter as it allows to measure the only contribution of reversible magnet 5, as it will be hereinafter explained.

Although a single pair of sensors 11 and 12 is enough to control the working of a pole pair of an electropermanent magnet, each electropermanent magnet is preferably provided with its own pair of sensors in order to achieve a greater measure accuracy. Thus, a lower coil and an upper coil (not shown in figure) are also arranged around core 6*b*' of the magnet, both connected to safety device 13, so as to reduce the measure error by averaging the readings of the two pairs of coils.

Figure 3:
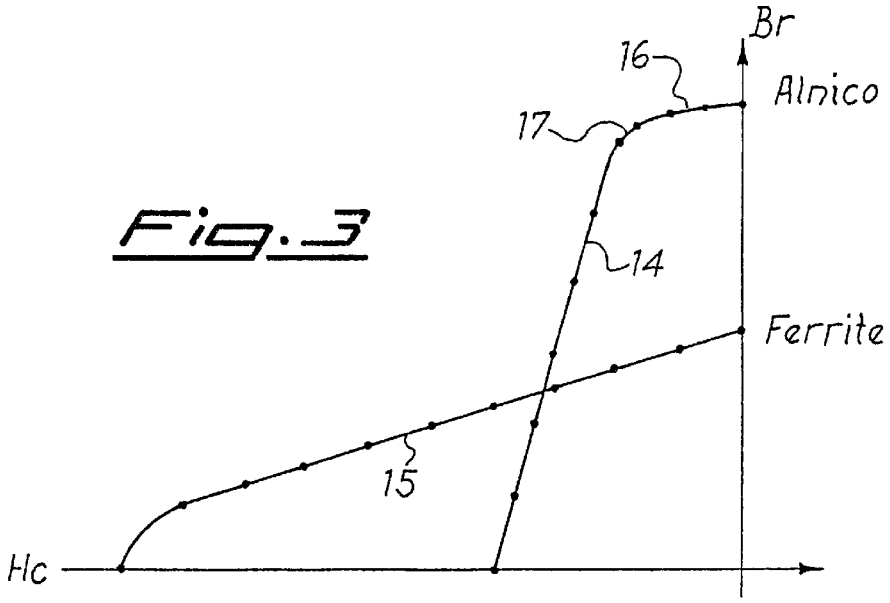
FIG. 3 is a diagram comprising the magnetization curves of the reversible magnet and of the permanent magnet.

Referring to FIG. 3, the magnetization curve showing the ratio between residual induction Br and coercive field intensity Hc has two different characteristics depending on the magnet type of the lifter. In particular, magnetization curve 14 of reversible magnets 5, 5', unlike curve 15 of permanent magnets 6, 6', has a quite short linear segment 16 between "knee" 17 and the axis of residual induction Br corresponding to a zero level of coercive field intensity Hc. Beyond "knee" 17, magnetization curve 14 is highly sloped and shows hysteresis phenomena, whereby, if the working point of the lifter accidentally comes in that region, its lifting force is unstable, since residual induction Br swiftly varies upon slight variations of intensity Hc and moreover there is no bijection between these two quantities owing to the magnetic hysteresis.

Figure 4:
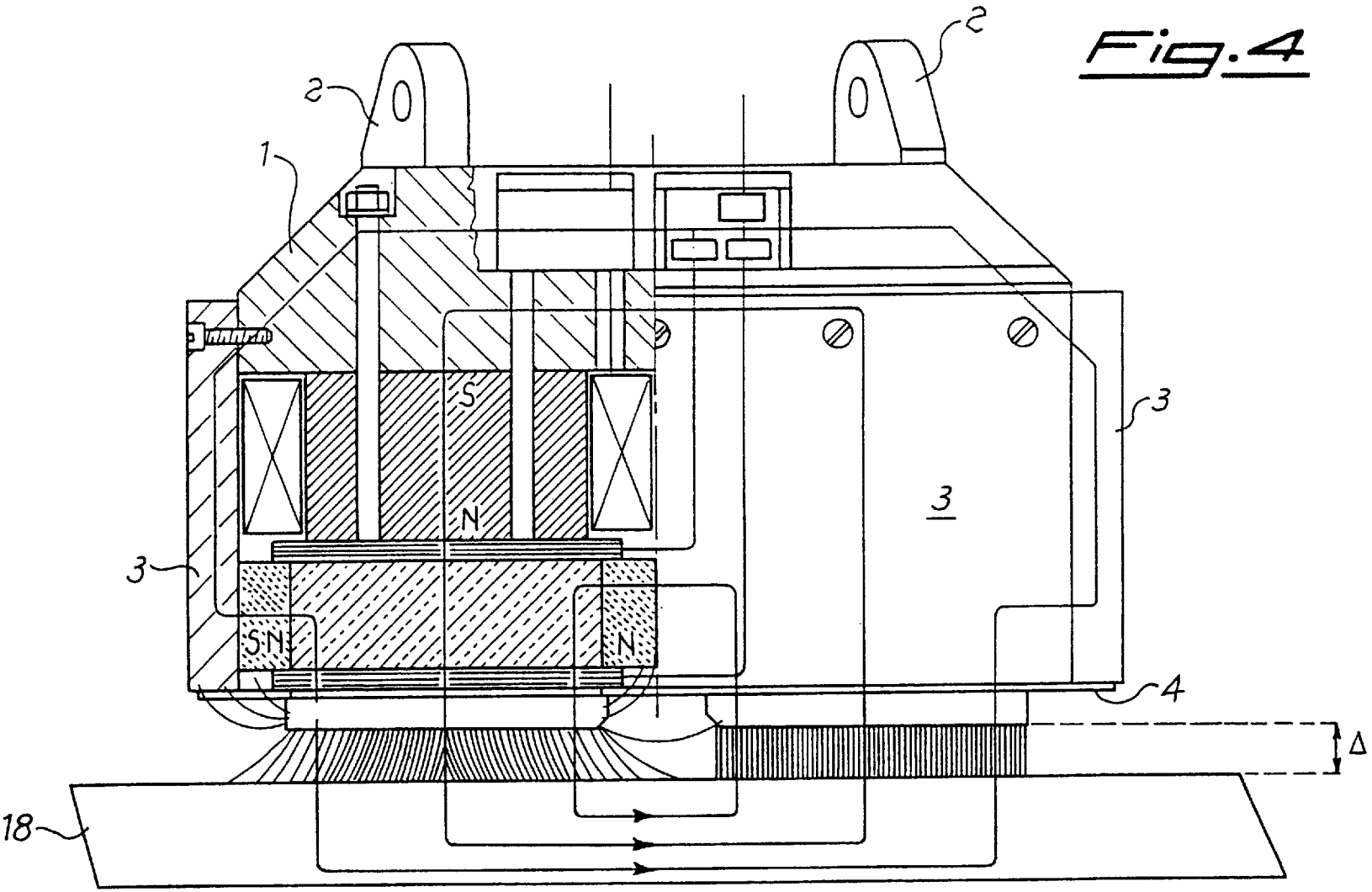
FIG. 4 is a view of the lifter of FIG. 1, in the load conveying phase.

Referring now also to FIG. 4, a ferromagnetic load 18 may be attracted by the lifter according to the present invention by placing it close to pole pieces 6*c*, 6*c*' and by reversing the polarities of reversible magnets 5, 5' through the respective commuting coils. Thus the magnetic flux lines are no longer linked with those of permanent magnets 6*a*, 6*a*', as shown in FIG. 1. Instead, all the flux lines pass through load 18, since, thanks to the particular magnet arrangement, the magnetic circuit is forced to come out of pole piece 6*c* and go back into pole piece 6*c*'. Also in this case a magnetic field is induced comprising three sheaves of flux lines, which are however substantially oriented in the direction indicated by the arrows in FIG. 4 and thus being concentric.

In particular, it should be noted that the flux lines passing through reversible magnets 5, 5' do not pass through ferrite blocks 6*a*, 6*a*', thus not being affected by the magnetic field generated therefrom. Therefore sensors 12 detect the intensity of the magnetic flux generated only by the reversible magnets, whereas sensors 11 also detect the contribution given by ferrite blocks 6*a*, 6*a*'.

Safety device 13 in the present embodiment comprises an electronic circuit controlled by a microprocessor receiving as input the signals transmitted by sensors 11 and 12 and subsequently amplified and converted in digital form. Device 13 processes the signals of sensors 11 and 12 in order to respectively obtain the total magnetic force of the electropermanent magnets and the working point of reversible magnets 5, 5' on curve 14. By comparing such values with each other, device 13 compensates the difference between the magnetic flux measured by sensors 11 and the magnetic flux actually passing through load 18. Such a difference results from the dispersions of the magnetic flux due to the air gap Δ, i.e. to the variations of the distance between load 18 and pole pieces 6*c*, 6*c*'. In FIG. 4 on the left the flux lines are shown through the air gap Δ (enlarged) under real conditions, i.e. with the dispersion effects, and on the right the same flux lines under ideal conditions, i.e. without the dispersion effects.

Thanks to sensors 12 arranged over the permanent magnets, device 13 determines the working point of reversible magnets 5, 5' on curve 14 of FIG. 3, and accordingly calculates in sequence the size of air gap Δ, the value of induction Br, the magnetic linkage with load 18 and finally the effective magnetic force acting on the latter. The software of safety device 13 thus comprises a specific algorithm capable of automatically correct the readings of sensors 11 so as to eliminate the errors due to the dispersed magnetic fluxes owing to the air gap Δ.

Should the effective magnetic force operating on load 18 be insufficient for its lifting, or should the working point of reversible magnets 5, 5' not be on linear segment 16, device 13 would provide for immediately signaling the risk situation to the operators by means of acoustic or optical alarm signals or the like.

Obviously the above described and illustrated embodiment of the lifter according to the invention is only an example susceptible of various modifications. In particular, the material the magnets are made of may vary depending on the lifter requirements. For example, the permanent magnets may be made of neodymium or other rare earths.

Likewise obviously, in another embodiment of the lifter according to the present invention, magnetic sensors 11 and 12 may not comprise coils, but other type of sensors, e.g. Hall effect sensors.

What is claimed is:

1. A lifter comprising:

a reversible magnet having a magnetization curve, a commuting coil with a longitudinal axis, and opposite polarities oriented along said longitudinal axis;

at least a working point on said magnetization curve of said reversible magnet;

a ferromagnetic core having sides and a base, and adapted to contact a load to be lifted by said lifter;

a pair of permanent magnets each arranged on one of said sides of said ferromagnetic core with their polarities oriented along an axis perpendicular to said longitudinal axis of said commuting coil;

a first magnetic sensor disposed adjacent said base of said ferromagnetic core;

a second magnetic sensor disposed above said permanent magnets for measuring the magnetic flux passing through said reversible magnet; and a safety device for processing signals transmitted by said first and second magnetic sensors and obtaining said working point of said lifter on the magnetization curve of said reversible magnet.

2. The lifter of claim 1, wherein said reversible magnet is disposed above said permanent magnets and includes first and second reversible magnets having polarities oriented mutually reversed along said longitudinal axis, and wherein the magnetic fluxes induced by said reversible magnets are linked together.

3. The lifter of claim 1, wherein said ferromagnetic core includes first and second ferromagnetic cores, wherein said first magnetic sensor includes a magnetic sensor disposed adjacent said base of each of said ferromagnetic cores, wherein said reversible magnet includes first and second reversible magnets, and wherein said second magnetic sensor includes a magnetic sensor disposed between each of said reversible magnets and said permanent magnets.

4. The lifter of claim 1, wherein said reversible magnet is made of a metallic alloy comprising aluminum, nickel, and cobalt.

5. The lifter of claim 1, wherein at least one of said first and second magnetic sensors includes a coil having loops surrounding a portion of said ferromagnetic core.

6. The lifter of claim 1, wherein at least one of said first and second magnetic sensors comprises a Hall effect sensor.

7. The lifter of claim 1, wherein said reversible magnet, said ferromagnetic core and said permanent magnets are housed inside a highly magnetically conductive structure, the base of said ferromagnetic core protruding outside said structure.

8. The lifter of claim 1, wherein said safety device comprises an electronic circuit controlled by a microprocessor with at least an input for receiving signals transmitted by said first and second magnetic sensors, said electronic circuit adapted to convert said signals into digital form.

9. The lifter of claim 1, wherein said safety device is adapted to calculate the magnetic flux passing through the load lifted by said lifter depending on the difference of values detected through said first and second magnetic sensors.

10. The lifter of claim 1, wherein said magnetization curve of said reversible magnets comprises a linear segment between a knee and the axis of the residual induction corresponding to a zero level of the coercive field intensity, and said safety device comprises alarm means being automatically activated if the working point of said lifter on the magnetization curve of said reversible magnets is not comprised in said linear segment.

* * * * *